US006119580A

United States Patent [19]

Sato et al.

[11] Patent Number: 6,119,580

[45] Date of Patent: Sep. 19, 2000

[54] SWASH PLATE TYPE HYDRAULIC ROTATING MACHINE AND METHOD OF MANUFACTURING CASING FOR SAME

[75] Inventors: Hitoshi Sato; Hitoshi Kagiwada, both of Tsuchiura; Kenichi Kimura, Ushiku, all of Japan

[73] Assignee: Hitachi Construction Machinery Co., Ltd., Tokyo, Japan

[21] Appl. No.: 09/068,537

[22] PCT Filed: Oct. 7, 1997

[86] PCT No.: PCT/JP97/03593

§ 371 Date: May 13, 1998

§ 102(e) Date: May 13, 1998

[87] PCT Pub. No.: WO98/15734

PCT Pub. Date: Apr. 16, 1998

[30] Foreign Application Priority Data

Oct. 8, 1996 [JP] Japan ..... 8/286093
Feb. 24, 1997 [JP] Japan ..... 9/55635

[51] Int. Cl.[7] ..... F01B 3/00

[52] U.S. Cl. ..... 92/12.2; 29/527.5; 29/527.6; 29/888; 29/848.02

[58] Field of Search ..... 92/12.2; 29/527.5, 29/527.6, 888, 848.02

[56] References Cited

FOREIGN PATENT DOCUMENTS 4272482 of 1992 Japan .

*Primary Examiner*—Edward K. Look
*Assistant Examiner*—Hermes Rodriguez
*Attorney, Agent, or Firm*—Antonelli, Terry, Stout & Kraus, LLP

[57] ABSTRACT

At the time of casting a structural material for a casing, metal pipes to be used as passages to and from a tilt actuator of a swash plate are integrally embedded in a cast body of the structural material. In a casting stage of the structural material for the casing, metal pipes are set in position within a casting mold, and then molten metallic material is introduced into the mold. A main casing for a hydraulic motor is formed out of the cast structural material by finishing its inner and outer peripheral surfaces and outer ends of embedded metal pipes. The resulting casing has the metal pipe conduits embedded in its cylindrical body portion from its open end toward its bottom portion with cylinders for a tilt actuator, the embedded metal pipe conduits providing passages on the inner peripheral side for supplying and discharging tilt control hydraulic fluid to and from the tilt actuator.

14 Claims, 10 Drawing Sheets

SWASH PLATE TYPE HYDRAULIC ROTATING MACHINE AND METHOD OF MANUFACTURING CASING FOR SAME

TECHNICAL FIELD

The present invention relates to a swash plate type hydraulic rotational machine suitable for use on construction machines such as hydraulic excavator or the like to serve as a hydraulic pump or as a hydraulic motor, and a method for manufacturing a casing for a hydraulic rotational machine of this sort.

BACKGROUND OF THE INVENTION

Generally, as a hydraulic pressure source, hydraulic construction machines like hydraulic excavators are provided with a hydraulic pump, along with a rotational drive motor or a vehicle drive motor. For a hydraulic motor or hydraulic pump of this class, it has been known in the art to employ a swash plate type hydraulic rotational machine, for example, as disclosed in Japanese Patent Laid-Open No. H4-272482.

FIGS. 6 through 10 show examples of conventional swash plate type hydraulic rotational machine of the sort mentioned above, which are applied as a vehicle drive hydraulic motor.

More specifically, FIGS. 6 through 9 show a first example of the prior art. Indicated at 1 is a vehicle drive hydraulic motor which is constituted by a variable displacement swash plate type hydraulic rotational machine, for rotationally driving sprockets 35 through a speed reducer, which will be described hereinafter, which drive, for example, crawler belts (not shown) of a hydraulic excavator.

Designated at 2 is a casing of the hydraulic motor 1, the casing 2 being constituted by a main casing 3 and a rear casing 4 which closes an open axial end of the main casing 3 as shown in FIG. 7. The main casing 3 is formed in a cup-like shape which is open at one axial end and consists of a generally stepped cylindrical body portion 3A and a bottom portion 3B. Formed integrally with the outer periphery of the cylindrical body portion 3A is an annular flange 3C which is securely fixed to a truck frame (not shown) of the aforementioned hydraulic excavator by way of a number of screw holes 3D. Further, formed on the inner peripheral side of the stepped cylindrical body portion 3A is a double-step wall portion 3E which has its diameter increased in two steps toward the open end of the casing for mounting a brake device thereon.

Indicated at 5 is a drive shaft which is rotatably supported in the casing 2 as a rotational shaft, and at 6 is a rotor which is rotatably provided in the casing 2. This rotor 6 is splined on the outer periphery of the drive shaft 5 and located within the stepped body portion 3A of the main casing 3. Formed in the rotor 6 are a plural number of cylinders 7 which are extended in the axial direction at angularly spaced positions around the drive shaft 5. As will be described hereinafter, a piston 10 is reciprocably fitted in each one of the cylinders 7.

Denoted at 8 is a valve plate which is located between the rear casing 4 and the rotor 6 and securely fixed to the rear casing 4. This valve plate 8 is provided with a pair of supply and discharge ports 8A (only one of which is shown in the drawings) which are intermittently communicated with the respective cylinders 7 of the rotor 6. In turn, the supply and discharge ports 8A are communicated with a pair of supply and discharge passages 9 (only one of which is shown in the drawings) which are respectively formed in the rear casing 4.

Indicated at 10 are a plural number of pistons having one end portions thereof slidably fitted in the cylinders 7 of the rotor 6 and the other end portions projected out of the respective cylinders 7. The reference numeral 11 denotes a plural number of shoes which are swivelably mounted on the respective projected ends of the pistons 10. These shoes 11 are held in sliding contact with a swash plate 12, which will be described below, to guarantee smooth rotation of the rotor 6 relative to the swash plate 12.

Indicated at 12 is the swash plate which is tiltably mounted on the side of the bottom portion 3B of the main casing 3. The swash plate 12 is provided with an inclined surface 12A which is inclined relative to the center axis of the drive shaft 5 and held in sliding contact with the respective ones of the afore-mentioned shoes 11. The stroke lengths of the respective pistons 10, which determine the capacity of the hydraulic motor 1, are variable according to the inclination angle of the inclined surface 12A of the swash plate 12.

Indicated at 13 is a tilt support member which is provided on the side of the bottom portion 3B of the main casing 3 and formed in a semi-spherical shape for engagement with the back side of the swash plate 12. This tilt support member 13 serves as a fulcrum point in tilting the swash plate 12 to guarantees smooth tilting movements of the swash plate 12 on the side of the bottom portion 3B of the main casing 3. In this instance, the tilt support 13 is provided on each side of the drive shaft 5.

Indicated at 14 is a tilt actuator which is provided on the part of the bottom portion 3B of the main casing 3, and, as shown in FIG. 7, largely constituted by a pair of cylinders 15 which are formed axially on the side of the bottom portion 3B of the main casing 3 at spaced positions in the radial direction of the drive shaft 5, and a pair of tilt control pistons 16 which have respective base end portions slidably fitted in the cylinders 15, with the respective fore ends abutted against the back side of the swash plate 12.

By control pressures which are supplied to the respective cylinders 15 of the tilt actuator 14, through oil passage 17 which will be described hereinafter, one of the tilt control pistons 16 is extended out of its cylinder 15 while the other tilt control piston 16 is retracted into its cylinder 15. Thus, the tilt angle of the swash plate 12 is changeably controlled by the tilt actuator 14, by way of the respective tilt control pistons 16 which tilt the swash plate 12 about the tilt support portion 13 as a fulcrum point.

Indicated at 17 are oil passages which are bored through the main casing 3 to serve as passages for tilt control liquid pressures. These oil passage 17 are extended axially through the main casing body 3 in an askew or oblique fashion, and, at one end or at the open end of the cylindrical body portion 3A, are constantly communicated with oil passages 18 and 19 which will be described hereinafter. At the other end, the passages 17 are communicated with the cylinders 15 of the tilt actuator 14 to supply control pressures to and from the cylinders 15.

Denoted at 18 and 19 are oil passages which are formed in the rear casing 4, and denoted at 20 is a volumetric control valve which is provided in the rear casing between the oil passages 18 and 19. In this instance, the volumetric control valve 20 is manually switched by an operator of the hydraulic excavator or the like to supply part of oil pressure in the afore-mentioned oil passage 9 selectively to the oil passages 18 and 19. Thus, the tilt angle of the swash plate 12 is variably controlled by the tilt actuator 14 as mentioned hereinbefore, by supplying a control pressure of high level to one of the oil passage 17 which are in communication with these oil passage 18 and 19, while holding the other oil passage 17 at a lower pressure level.

Indicated at 21 is a negative type brake device which is located between the main casing 3 and the rotor 6 for applying brakes on the rotor 6 and rotational shaft 5. In this instance, as shown in FIG. 7, the negative type brake device 21 is constituted by; an annular stopper 22 which is fixedly mounted on the stepped wall portion 3E on the inner periphery of the stepped cylindrical body portion 3A of the main casing 3; a plural number of brake plates 23 which are mounted on the stepped wall portion 3E adjacent to the stopper 22 for movements in the axial direction but blocked against movements in the rotational direction; a plural number of friction plates 24 which are interposed between the respective brake plates 23 and mounted on the outer periphery of the rotor 6 for movements in the axial direction but are blocked against movements in the rotational direction; a brake piston 25 which is slidably fitted in the stepped wall portion 3E on the side of the open end of the cylindrical body portion 3A; a spring 26 which is interposed between the rear casing 4 and the brake piston 25 to bias the brake piston 25 constantly toward the brake plates 23; and a liquid pressure chamber 27.

Under the influence of the biasing force of the spring 26, the brake device 21 functions to hold the brake plates 23 in frictional contact with the respective friction plates 24 between the brake piston 25 and the stopper 22, applying the so-called parking brakes arresting the rotor 6 along with the drive shaft 5.

Designated at 27 is a hydraulic chamber which constitutes part of the brake device 21. As shown in FIG. 8, the hydraulic chamber 27 is formed between the cylindrical body portion 3A of the main casing 3 and the brake piston 25, and supplied with a brake cancellation pressure through oil passages 28 and 29 which will be described hereinafter. As the brake cancellation pressure in the hydraulic chamber 27 rises to overcome a preset biasing force of the spring 26, the piston 25 is thereby pushed against the action of the spring 26. As a result, the respective brake plates 23 are pushed into positions which are slightly spaced from the friction plates 24 to release the rotor 6 and drive shaft 5.

Designated at 28 and 29 are oil passages which convey brake cancellation pressure to be fed to and from the hydraulic chamber 27 of the brake device 21. Of these oil passages 28 and 29, as shown FIG. 8 the oil passage 28 is extended obliquely through the cylindrical body portion 3A of the main casing 3, and communicated with the oil passage 29 at one end thereof on the side of the open end of the cylindrical body portion 3A and communicated with the hydraulic chamber 27 at the other end. On the other hand, the oil passage 29 is formed in the rear casing 4, and connected to one of the aforementioned paired supply and discharge passages 9 which is at a high pressure level, through a high pressure selector valve such as a shuttle valve (not shown).

In this instance, at the time of rotationally driving the hydraulic motor 1, the hydraulic fluid which is supplied to the hydraulic motor 1 from an oil pressure source (not shown) through a directional change-over valve is led to the oil passage 29 through the afore-mentioned high pressure selector valve. Further, this hydraulic fluid is supplied as a brake cancellation pressure to the hydraulic chamber 27 through the passages 28, so that the brake device 21 releases the brakes on the rotor 6 and the drive shaft 5, permitting to start the hydraulic motor 1.

Further, at the time of stopping rotation of the hydraulic motor 1, the supply of hydraulic fluid from the oil pressure source is blocked by the above-mentioned directional change-over valve, whereupon the oil pressure (the brake cancellation pressure) in supply to the passages 29 and 28 through the high pressure selector valve drops down to the level of tank pressure. Therefore, the brake device 21 is applied by the action of the spring 26 as described above, braking the rotor 6 and the drive shaft 5 against rotation.

Indicated at 31 is a reducer for the vehicle drive, which is provided in the main casing 3 of the hydraulic motor 1 as shown in FIG. 6. This reducer 31 is largely constituted by a housing 32 of cylindrical cup-like shape which is rotatably mounted on the side of the bottom portion 3B of the main casing 3, and two-stage planetary gear systems 33 and 34 which are provided in the housing 32. A sprocket 35 is mounted on the outer peripheral side of the housing 32 to serve as a drive wheel.

Further, provided within and on the center axis of the housing 32 of the reducer 31 is a rotational shaft 36 which is splined with the drive shaft 5 of the hydraulic motor 1 for rotation therewith. As the rotational shaft 36 is driven by rotation of the hydraulic motor 1, its rotation is transmitted to and reduced through the planetary gear system 33 of the first stage, and then further reduced through the planetary gear system 34 of the second stage. In this instance, by rotation of the housing 32, rotation of large torque is transmitted to the sprocket 35.

With the hydraulic motor 1, which is constituted by a conventional swash plate type hydraulic rotational machine of the construction as described above, the hydraulic fluid in supply and discharge to the hydraulic motor 1 from an oil pressure source is fed to and from the respective cylinders 7 of the rotor 6 through the supply and discharge passages 9 in the rear casing 4 and through the supply and discharge ports 8A in the valve plate 8. As a result, pushing force is generated in each one of the pistons 10, acting against the swash plate 12 through the shoes 11. By this pushing force, the respective shoes 11 are glided on and along the inclined surface 12A of the swash plate 12 to rotate the rotor 6 integrally therewith through the pistons 10. This rotation of the rotor is transmitted to the reducer 31 through the drive shaft 5.

At this time, if the volumetric control valve 20 is switched by the operator of the hydraulic excavator, part of the hydraulic fluid in supply to the afore-mentioned supply and discharge passages 9 is selectively supplied to either one of the passages 18 and 19 as a control pressure. By this operation, a control pressure of high level is supplied to one of the passage 17, which are in communication with the passages 18 and 19, while the other one of the passage 17 remains at a low pressure level. This control pressure causes one of the tilt control pistons 16 of the tilt actuator 14 to extend out of its cylinder 15 while retracting the other piston 16 into its cylinder 15.

As a result, by the tilt control pistons 16, the swash plate 12 is turned about the tilt support portion 13 to move into a tilted position of a different angle. Namely, the tilt angle of the swash plate 12 is variably controllable by way of the tilt actuator 14. When the swash plate 12 is set at a maximum tilt angle, each piston 10 is displaced over a maximum stroke distance. In this position, the flow rate which is necessary for rotating the rotor 6 is increased, permitting to rotate the drive shaft at low speed and with high torque. On the other hand, when the swash plate 12 is set at a minimum tilt angle, each piston 10 is displaced over a minimum stroke length. In this position, the flow rate which is necessary for rotating the rotor 6 is reduced, permitting to rotate the drive shaft 5 at high speed and with low torque.

Illustrated in FIG. 9 is a casting stage in a process for fabricating a cast structural material for the main casing 3 of the hydraulic motor 1.

A cast structural material 46 is produced by the use of a casting mold set 41, i.e., a split mold set consisting of upper and lower mold sections 42 and 43, which are butt-joined one on the other, and a core 44. This mold is, for example, a sand mold which is formed of casting sand or the like. The upper and lower mold sections 42 and 43 are internally provided with cavities 42A and 43A, respectively. Formed in the upper mold 42 is a sprue 45, through which molten metallic material F is poured into the mold 41. Further, the core 44, which is set in position between the upper and lower molds 42 and 43 is provided with cylindrical projections 44A at its upper end, at positions which correspond to the respective cylinders 15 of the tilt actuator 14.

In the state as shown in FIG. 9, molten metallic material F is introduced into the casting mold 41 in the arrowed direction, and then allowed to solidify to shape with gradual cooling to obtain a cast structural material 46 of a shape which is defined by the mold cavities 42A and 43 and the core 44.

Nextly, after ejection of the cast structural material 46 from the mold 41, a main casing 3 for the hydraulic motor 1 is formed out of the cast structural material 46 by removing outer peripheral surfaces of the structural material 46 by machining up to the positions as indicated by two-dot chain lines in FIG. 9. Then, drilled holes 47 of narrow elongated form are bored axially in an obliquely inclined fashion through the cast structural material 46, from one axial end toward the other axial end thereof, to provide the passage 17 or pressurized liquid passages.

On the other hand, according to a second prior art shown in FIG. 10, a cast structural material 56 is produced by the use of a casting mold 51, e.g., a sand mold consisting of upper and lower molds 52 and 53 and a core 54. The upper mold 52 is provided with a sprue 55 for pouring a molten metallic material F into the mold 51. Further, the core 55 which is set in position between the upper and lower molds 52 and 53 is provided with cylindrical projections 54A at its upper end, more specifically, at positions which correspond to the aforementioned cylinders 15.

Molten metallic material F is poured into the casting mold 51 of FIG. 10 in the arrowed direction, and, after obtaining a cast structural material 56, a main casing 3' is form out of the cast structural material similarly by machining same, i.e., by machining outer peripheral surfaces of the casting 56 up to the positions indicated by two-dot chain lines in FIG. 10. Then, a plural number of drilled holes 57, including narrow and elongated drilled holes 57A to 57D, are bored through the cast structural material 56 to provide the passage 17'.

According to the firstly mentioned prior art, after casting the structural material 46 for the main casing 3 by the use of the casting mold 41, inner and outer peripheral surfaces of the cast structural material 46 are machined down to the shape of the main casing 3 of hydraulic motor 1. Then, elongated narrow drilled holes 47 are bored through the cast structural material 46 obliquely in the axial direction from one to the other end thereof to provide the passage 17 as described above.

Therefore, according to the first prior art, the cast structural material 46 (the main casing 3) needs to have an increased wall thickness in those regions which contain the drilled holes 47, in order to prevent the drilled holes from breaking out through the wall of the cast structural material 46 in the course of drilling operations. However, in case the wall thickness of the cast structural material 46 is increased, casting defects are likely to occur due to large variations in wall thickness around the projections 44A which are formed on the core 44.

Such casting defects, if remain in the main casing 3, can invite a problem of oil leakage from the oil conduits 17 which convey high hydraulic fluid. Further, due to the necessity for boring the drilled holes 47 in the cast structural material 46 for the passage 17, the drilling operation consumes a great deal of time and labor to such a degree as to deteriorate the operational efficiency to a considerable degree in manufacturing main casings 3 from cast structural material 46.

Further, in the case of the cast structural material 46 by the prior art shown in FIG. 9, the wall thickness as well as the axial length of the cast structural material 46 has to be increased in order to bore the drilled holes 47 linearly in oblique directions. Therefore, when a reducer 31 is mounted on a main casing 3 as shown in FIG. 6, the rotational machine as a whole has a large length which may give rise to various problems, for example, damages to the housing 32 of the reducer 31 as caused by jumping stones or rocks when end portions of the reducer 31 are protruded on the outer side of a crawler belt.

On the other hand, according to the second prior art shown in FIG. 10, it is possible to reduce the axial length of the cast structural material 56. In this case, however, a plural number of drilled holes 57 have to be bored through the cast structural material, more specifically, a plural number of narrow and elongated drilled holes 57A to 57D for use as the passage 17'.

The boring operations for the drilled holes 57 of this nature require higher precision work and extra time and labor in order to bring the elongated narrow drilled holes 57A to 57D into predetermined aligned positions at the respective fore ends. Besides, of the elongated narrow holes 57A to 57D, for example, the ends of the narrow elongated holes 57B to 57D which are open to the outside of the cast structural material 56, have to be closed with plugs despite high probabiilities of oil leakage through plugged ends.

DISCLOSURE OF THE INVENTION

In view of the problems of the prior art as described above, it is an object of the present invention to provide a swash plate type hydraulic rotational machine with a casing which is formed out of a cast structural material and which is internally provided with hydraulic passages for supplying or discharging swash plate tilting pressures by way of metal pipes which are integrally embedded in the body of the cast structural material in a casting stage thereof, and a method for manufacturing the casing for the said hydraulic rotational machine.

It is another object of the present invention to provide a swash plate type hydraulic rotational machine with a casing which is internally formed with hydraulic passages by embedded metal pipes in the cast structural material in a casting stage thereof, permitting to abolish machining operations which would normally required in a next stage for boring hydraulic passages and preventing leaks from the hydraulic passages in an extremely reliable manner, while allowing broader freedom in designing, reductions in material and manufacturing costs, and a method for manufacturing the casing of the said hydraulic rotational machine.

It is still another object of the present invention to provide a swash plate type hydraulic rotational machine with a casing which has metal pipes embedded in the cast structural material, and containing curved or bent portions correspondingly to the profile of a cylindrical body portion of the cast structural material, permitting to reduce the wall thickness and weight of the cylindrical body portion of the cast structural material and to make same compact even in a case where the metal pipes are embedded in the axial direction, and a method for manufacturing the casing of the said hydraulic rotational machine.

For achieving the above-stated objectives, the present invention is to be applied to a swash plate type hydraulic rotational machine comprising a cylindrical casing opened at one axial end, a rotational shaft rotatably mounted within the casing, a rotor mounted on the rotational shaft for rotation therewith and provided with a plural number of axial cylinders, a plural number of pistons having one end portions thereof slidably fitted in the cylinders of the rotor and the other end portions projected out of the respective cylinders, a plural number of shoes provided on projected ends of the pistons, a swash plate mounted within the casing on the side of projected ends of the pistons and having an inclined surface held in sliding contact with said shoes as the rotor is put in rotation, and a tilt actuator provided within the casing between the swash plate and the other end of the casing and adapted to move the swash plate into a tilted position with hydraulic fluid supplied or discharged thereto.

According to a feature in construction employed by the present invention, the casing is formed out of a cast structural material containing metal pipes which are completely embedded in a cast body of the structural material on outer peripheral side thereof and providing hydraulic passages on inner peripheral side for use as conduits for supplying or discharging hydraulic fluid to and from the tilt actuator.

With the arrangements just described, according to hydraulic liquid which are supplied or discharged through the hydraulic passages, the tilt actuator operates to move the wash plate in the casing into a position of a desired tilt angle in controlling the displacement of the hydraulic rotational machine. In a casting stage of the structural material for the main casing of the swash plate type hydraulic rotational machine, metal pipes are completely embedded in the cast body of the structural material to form hydraulic passages integrally therein, abolishing the boring operations which have thus far been necessitated in a next stage for opening internal hydraulic passages as in the prior art described hereinbefore.

The hydraulic passages which are formed by the embedded metal pipes can securely prevent leaks of tilt control pressures from the pressurized liquid passages.

In one particular form of hydraulic rotational machine according to the present invention, the cast structural material includes a cylindrical body portion which is open at one axial end, a bottom portion located at the other axial end of the cylindrical body portion and containing cylinders for the tilt actuator, and metal pipes which are extended axially through the cylindrical body portion from the open end toward the bottom portion mentioned above.

With the arrangements just described, the metal pipes can be provided axially through the cast structural material from one open end toward the other bottom end thereof even in those cases where the tilt actuator is located on the bottom side of the main casing.

In another particular form of the hydraulic rotational machine according to the invention, the cast structural material includes a cylindrical body portion having a gradually reduced diameter from an open axial end toward the other end thereof, and metal pipes which are embedded in the cast body of the structural material obliquely along the inner periphery of the cylindrical body portion.

With the arrangements just described, in a case where the structural material for the main casing is in a truncated conical shape with a gradually reduced diameter from one open end toward the other end thereof, the metal pipes can be embedded along and in conformity with the shape of inner periphery of the cylindrical body portion of the cast structural material.

In this instance, the inner periphery of the cylindrical body portion of the cast structural material may be in the form of a gradually stepped shape, and the metal pipes may contain arcuately curved or bent portions in conformity with the profile of stepped inner peripheral walls of the cylindrical body portion.

As a consequence, hydraulic passages of curved or bent shape can be formed easily by the metal pipes within a structural material with stepped inner peripheral surfaces without necessitating complicate boring operations in a next stage as in the second prior art shown in FIG. 10.

On the other hand, according to the present invention, for supplying and discharging brake cancellation pressure to and from a negative type brake device which is provided between a casing and a rotor, the cast structural material for the casing may further contain another metal pipes which are completely embedded in a cast body of the structural material on outer peripheral side and providing hydraulic passages on inner peripheral side for use as hydraulic passages for supplying and discharging hydraulic fluid to and from the brake device.

In this case, according to the operating hydraulic fluid which are supplied and discharged through the hydraulic passages, the negative type brake device either apply brakes to the rotational shaft through the rotor or cancel application of brakes. At the time of forming the cast structural material for the casing of a swash plate type hydraulic rotational machine by means of casting equipments, the metal pipes are completely embedded in the cast body of the structural material to form hydraulic passages for the brake device integrally therein to abolish the machining operations for boring pressurized liquid passages as in the prior art. Besides, the hydraulic passages which are formed by the embedded metal pipes can preclude possibilities of leaks of brake cancellation pressure.

Further, in the hydraulic rotational machine according to the present invention, the metal pipes are of narrow elongated shape and of a metallic material which has a melting point higher than that of the cast casing structure.

Therefore, since the metal pipes (pipe material) has a higher melting point than the metal for the structural material for the casing, there is no possibility of thermal deformations or thermal damages occurring to the metal pipes upon introduction of molten metallic material into a casting mold in a casting stage of the structural material.

Further, in the hydraulic rotational machine according to the present invention, preferably the metal pipes of narrow elongated shape are fixedly set in position within a casting mold by fixing opposite end portions of the metal pipes in the casting mold.

With the arrangements just described, the metal pipes which are fixed in position at the opposite axial ends can be accurately embedded in a cast body of the structural material.

On the other hand, the present invention is applied to a method for producing a cast structural material suitable for use as a casing of swash plate type hydraulic rotational machine having within a casing a rotational shaft, a rotor rotatable integrally with the rotational shaft and provided with a plural number of axial cylinders, a plural number of pistons slidably fitted in the respective cylinders of the rotor, a plural number of shoes provided on projected ends of the respective pistons, a swash plate located face to face with the projected ends of the pistons and held in sliding contact with the shoes as the rotor is put in rotation, and a tilt actuator for driving the swash plate into tilted positions in response to supplied and discharged hydraulic fluid.

More particularly, according to the present invention, there is provided a method for producing a cast structural material, which comprises the steps of: setting first metal pipes fixedly in position within a casting mold at the time of casting a structural material to be used as a casing, for forming within a cast body of said structural material hydraulic passages for use as conduits for supplying and discharging hydraulic fluid to and from the tilt actuator; and pouring molten metallic material into the casting mold in such a way as to completely enwrap outer peripheral side of the metal pipes.

According to the method just described, the metal pipes are fixedly set in position beforehand within a casting mold to be used for casting structural material for a casing of swash plate type hydraulic rotational machine. In that state, molten metallic material is poured into the casting mold in such a way as to completely enwrap the outer peripheral side of the metal pipes which form hydraulic passages internally of a cast body of the structural material to be used for the casing.

Further, the method according to the present invention may comprise the step of setting second metal pipes fixedly in position within a casting mold in addition to and along with the first-mentioned metal pipes, for forming within a cast body of the structural material additional hydraulic passages for supplying and discharging oil pressures to and from a negative type brake device located between the casing and rotor, in addition to the hydraulic passages for hydraulic fluid to be supplied and discharged to and from the tilt actuator.

With the arrangements just described, the second metal pipes can be set in position within a casting mold together with the first metal pipes in a positioning stage. Accordingly, in a succeeding casting stage, both of the first and second metal pipes can be simultaneously embedded in a cast body of the structural material to be produced.

Further, according to the method of the present invention, the metal pipes of narrow elongated shape are fixedly set in position within a casting mold by fixing opposite axial ends of the respective metal pipes in the mold.

With the arrangements just described, the respective metal pipes can be fixedly set in position within a casting mold stably in a positioning stage. Accordingly, in a succeeding casting stage, the metal pipes can be embedded in a cast body of structural material accurately, permitting to produce casing structures with a higher degree of accuracy.

Further, according to the method of the present invention, there may be employed a set of split mold, which is composed of a pair of separable mold sections and a core positioned between the two separable mold sections, and metal pipes which are integrally assembled with the core prior to a positioning stage, so that they can be set in position within a casting mold together with the core.

With the arrangements just described, since the metal pipes are integrally assembled with a core beforehand, they can be set in position within a casting mold simultaneously along with the core.

Further, according to the method of the present invention, there may be employed a set of split mold which is composed of a pair of separable mold sections and a core positioned between the two separable mold sections, and metal pipes having straight pipe portions extending in the same direction from the opposite axial ends thereof, so that the metal pipes can be integrally assembled with the core by inserting the straight pipe portions into the core from the same direction and set in position within a casting mold together with the core.

With the arrangements just described, in a preparatory stage, metal pipe fitting holes are formed in the core which constitutes part of the casting mold. The metal pipes can be integrally assembled with the core easily in a securely fixed state in a succeeding or subsequent stage by inserting the respective straight pipe portions into the fitting holes of the core. Therefore, in a next positioning stage, the metal pipes can be set in position within a split mold simultaneously together with the core.

Further, according to the method of the present invention, metal pipes which are assembled as an integral part of a core, are set in position within a casting mold in such a way that distal ends of the straight pipe portions are projected in an upward direction.

With the arrangements just described, the straight pipe portions at the opposite axial ends of the metal pipes are retained in an upwardly projected state within a casting mold. When molten metallic material is introduced into the casting mold in such a way as to completely enwrap the outer peripheral side of the metal pipes in a next casting stage, the straight pipe portions are forcibly pushed into the pipe fitting holes by buoyant force acting to push the metal pipes in an upward direction, thereby preventing the metal pipes coming off the core upon introduction of molten metallic material under pressure.

BEST MODE FOR CARRYING OUT THE INVENTION

Hereafter, the invention is described in greater detail by way of its preferred embodiments with reference to FIGS. 1 through 5.

Figure 1:
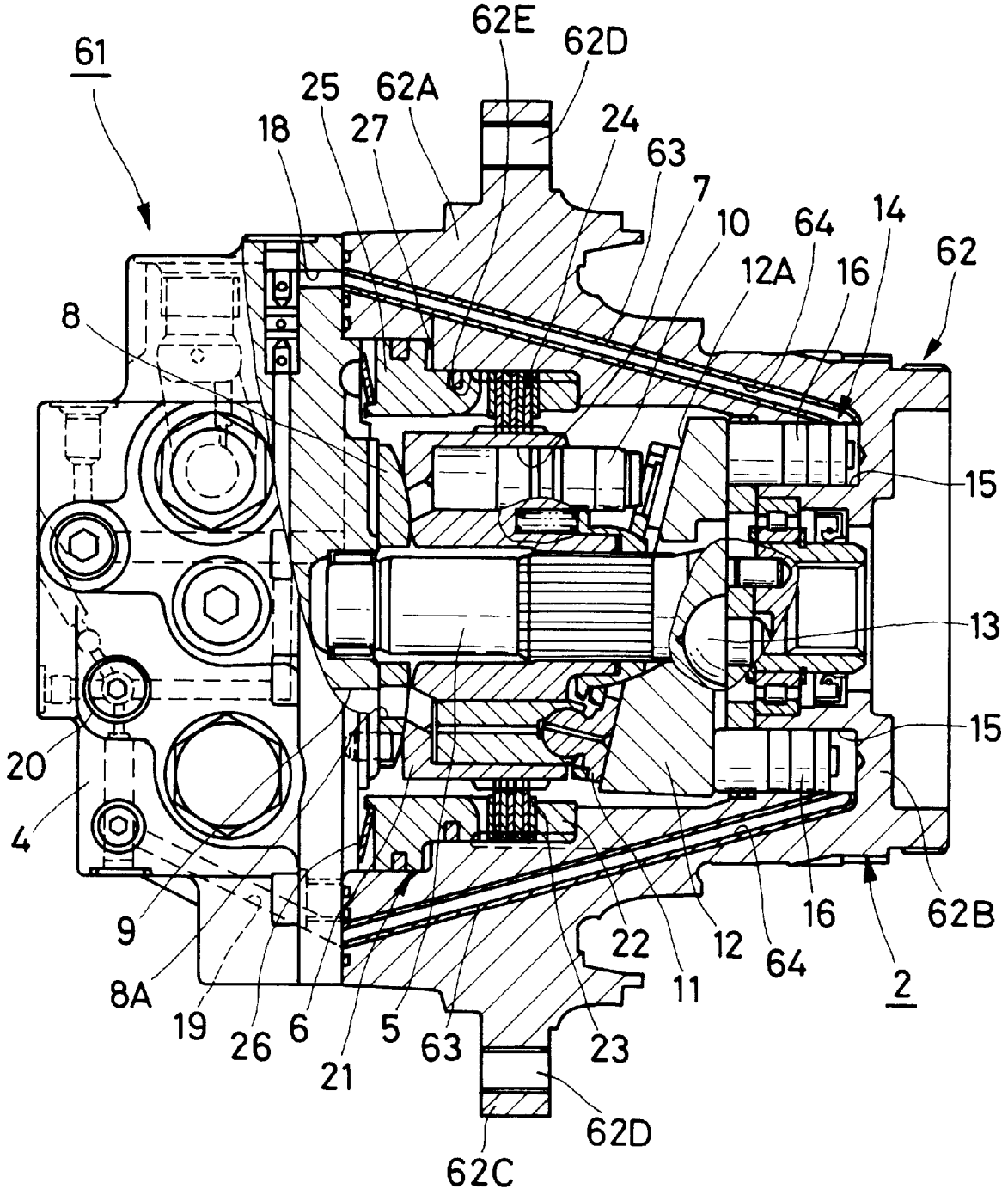
FIG. 1 is a vertical sectional view of a vehicle drive hydraulic motor according to a first embodiment of the present invention.
Figure 2:
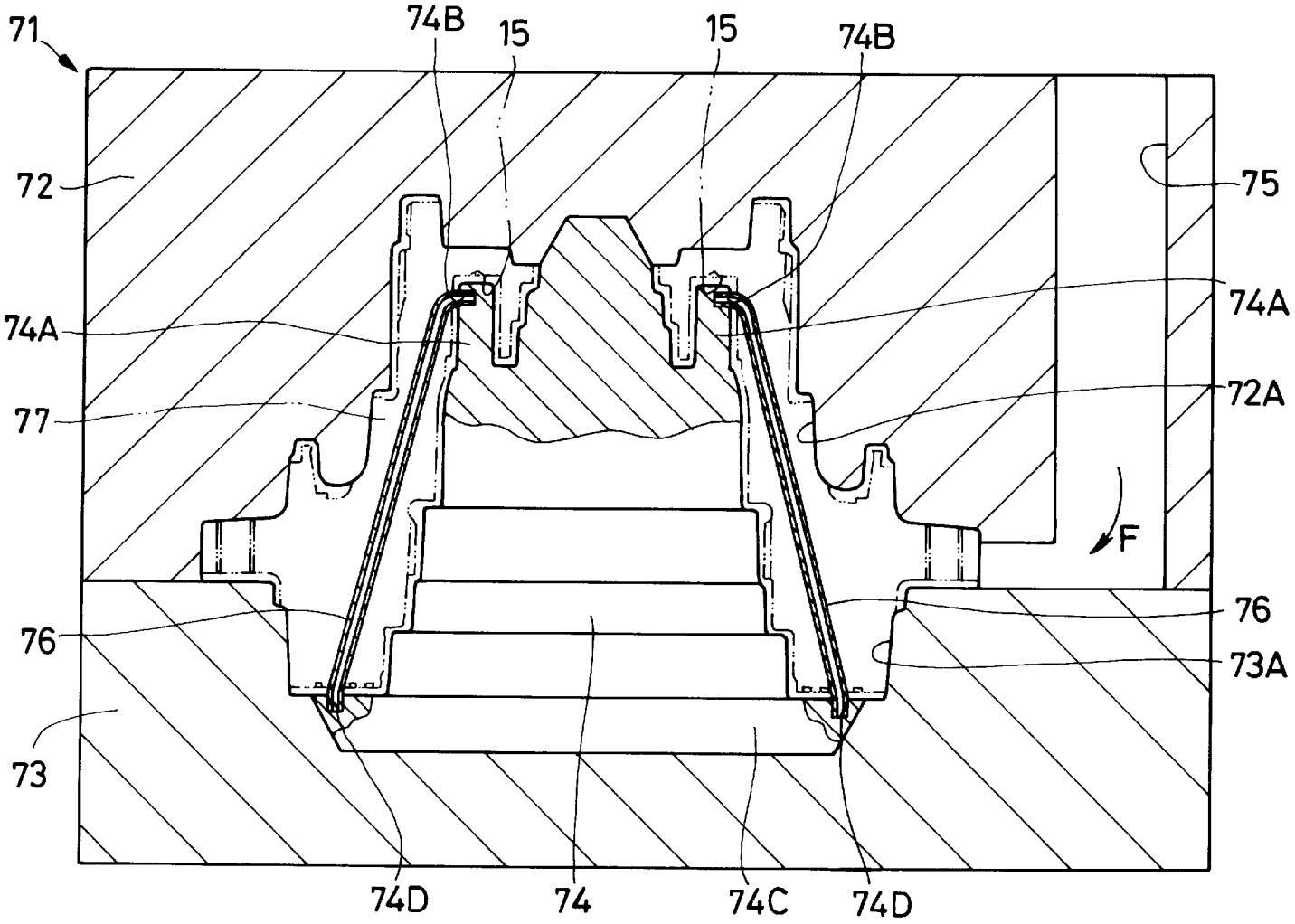
FIG. 2 is a vertical sectional view of a casting mold employed for casting a casing structure for hydraulic motor according to the first embodiment of the invention.

Illustrated in FIGS. 1 and 2 is a first embodiment of the present invention, where those component parts which are common with the counterparts in the first prior art, which has been described hereinbefore in connection with FIGS. 6 to 9, are simply designated by similar reference numerals or characters to avoid repetition of same explanations.

Shown in vertical section in FIG. 1 is a hydraulic motor embodying the present invention, in which indicated at 61 is a hydraulic motor according to this embodiment. In place of the main casing 3 of the above-described prior art, the hydraulic motor 61 is provided with a main casing 62.

Similarly to the main casing 3 of the prior art, the main casing 62 of this embodiment is formed in a cup-like shape which is open at one axial end, and constituted by a stepped cylindrical body portion 62A and a bottom portion 62B. The main casing 62 has an annular flange portion 62C integrally formed around the outer periphery of its cylindrical body portion 62A. By way of a number of screw holes 62D, this flange portion 62C is securely fixed to a truck frame of the hydraulic excavator. Formed on the inner periphery of the cylindrical body portion 62A is a stepped wall portion 62E for mounting a brake device thereon, the stepped wall portion 62E having a diameter which is increased stepwise toward the open end.

Indicated at 63 are metal pipe conduits which are embedded in the main casing 62. These embedded metal pipe conduits 63 form passage 64 internally of the main casing 62 to serve as hydraulic passages in place of passages 17 of the prior art described hereinbefore. The embedded metal pipe conduit 63 are extended through the main casing 62 axially in oblique directions. At an axial end on the side of the open axial end of the cylindrical body portion 62A, these metal pipe conduits 63 are so shaped as to be constantly communicable with passages 18 and 19, by machining ends of metal pipes 76 in the manner as will be described hereinafter. At the other axial end, the metal pipe conduits 63 are so shaped as to be communicable with cylinder portions 15 of the tilt actuator 14, similarly by machining the other ends of the respective metal pipes 76 in the manner as will be described hereinafter.

In this instance, each metal pipe conduit 63 is made of a metallic material, for example, iron material with a melting point equivalent to or higher than that of molten metallic material which is used for casting a structural material as will be described hereinafter.

In a stage of casting a structural material 77 for the main casing 62, while the metal pipe conduits 63 are completely enwrapped in molten metallic material on their outer peripheral side, hydraulic passages are formed internally of the respective metal pipe conduits 63 for use as passages 64. Similarly to passages 17 in the above-described prior art, the passages 64 are used for supplying and discharging tilt control hydraulic liquid to and from the respective cylinders 15 of the tilt actuator 14.

FIG. 2 shows in a vertical section a set of casting mold suitable for use in casting a structural material for the main casing 62 according to the first embodiment. In this figure, indicated at 71 is a casting mold for forming a cast structural material 77 and said casting mold 71 is constituted by a set of upper and lower molds 72 and 73 and a core 74 which is located between the upper and lower molds 72 and 73, similarly to the casting mold 41 of the above-described prior art. The upper and lower molds 72 and 73 and the core 74 are, for example, of sand mold. The upper and lower molds 72 and 73 are provided with cavities 72A and 73A, and a sprue 75 is provided in the upper mold 72 for pouring the molten metallic material F into the casting mold 71.

A pair of cylindrical projections 74A are formed at the upper end of the core 74 which is set in position between the upper and lower molds 72 and 73. These cylindrical projections 74A are formed in positions which correspond to the respective cylinders 15 of the tilt actuator 14 shown in FIG. 7. Formed radially into upper end portions of the projections 74A are narrow blind holes 74B for integrally fixing therein upper end portions of metal pipes 76 which will be described hereinafter. Further, formed into the outer periphery of a pedestal portion 74C of the core 74 which is mounted on the lower mold 73, are a pair of narrow pipe fitting holes 74D for integrally fixing therein lower end portions of the metal pipes 76.

In this instance, before being set in position within the casting mold 71, the metal pipes 76 are provided in the form of narrow straight pipes of metallic material such as iron or the like. The opposite ends of each metal pipe 76 are bent to a predetermined angle in order to enhance their coupling force in the pipe fitting holes 74B and 74D of the core 74. In this state, the metal pipes 76 are fixedly assembled with the core 74, for example, at the time of molding the core 74 by the use of casting sand or the like. By so doing, each metal pipe 76 is integrally assembled with the core 74 by way of its lower end (one end) which is integrally fixed in a pipe fitting hole 74D and its upper end (the other end) which is integrally fixed in the pipe fitting hole 74B of the core 74. Thereafter, in a casting stage of the structural material 77, the metal pipes 76 are completely enwrapped in the molten metal material F.

According to the present embodiment employing the arrangements just described, a cast structural material for the main casing 62 is produced by the method as follows.

Firstly, the opposite ends of the metal pipes 76 are bent to a predetermined angle in a preparatory stage. Prior to a casting stage, the opposite ends of the metal pipes 76 are stopped by press-fitting plug means (not shown) such as cork plugs, rubber plugs or metal plugs. In the next place, the core 74 is formed by molding casting sand or the like. At this time, the metal pipes 76 are integrally assembled with the core 74 by fixing the upper and lower ends of the metal pipes 76 in the pipe fitting holes 74B and 74D of the core 74, respectively. Thereafter, the core 74 is set in position between the upper and lower molds 72 and 73. Simultaneously with the positioning of the core 74, the metal pipes 76 are set in position within the casting mold 71 as shown in FIG. 2 (a positioning stage).

In this state, molten metal material F is poured into the casting mold 71 through the sprue 75 in the direction as indicated by an arrow to fill the casting mold 71 with the molten metal material F. Then, the molten metal material F is allowed to solidify to shape within the casting mold 71 under gradual cooling condition to produce a cast structural material 77 between the upper and lower mold cavities 72A and 73A and the core 74 (a casting stage). In this casting stage, the metal pipes 76 are enwrapped in the molten metal material F so that they are embedded in the body of the resulting cast structural material 77.

Nextly, after ejection of the cast structural material 77 from the casting mold 71, inner and outer peripheral surfaces of the cast structural material 77 are machined up to the positions indicated by two-dot chain lines in FIG. 2 to make the main casing body 62 for the hydraulic motor 61. In the state shown in FIG. 2, the opposite ends of the metal pipes 76, which are integrally fixed in the respective pipe fitting holes 74B and 74D of the core 74, are cut off from the metal pipes 76, and, after removing the core 74, projecting ends of the metal pipes 76 are removed by the use of a cutting tool, thereby preventing stubs of the metal pipes 76 from protruding on the cast structural material 77.

Thus, according to the present embodiment, metal pipes 76 are completely embedded in the cast structural material 77 to be used as the main casing 62, with outer peripheries of the metal pipes 76 completely enwrapped in the cast metal material F. Therefore, the main casing body 62 for the hydraulic motor 61 can be produced simply by finishing inner and outer surfaces of the cast structural material 77 after ejection from the casting mold 71. In this manner, the passages 64 to be used for supplying and discharging hydraulic fluid to and from the respective cylinders 15 of the tilt actuator 14 for control of the tilt angle can be formed quite easily in the body of the main casing 62 on the inner peripheral side of the embedded metal pipe conduits 63.

Thus, according to the present embodiment, the passages 64 can be formed in the main casing 62 in an extremely facilitated manner by embedding metal pipes 76 at the time of casting the cast structural material 77 for the main casing 62, permitting to manufacture the main casing 62, including the formation of internal passages 64 and machining work, very efficiently in a shortened period of time. As a consequence, the present embodiment makes it possible to provide the passages 64 in the body of the main casing 62 in a far facilitated manner as compared with the prior art of FIG. 9 which requires to bore elongated narrow drilled holes 47 from one to the other axial end of a cast casing structure 46.

In addition, according to the present embodiment, there is no necessity for increasing the wall thickness of the cast structural material 77 in the regions around the metal pipes 76, precluding undesirable variations in wall thickness of the cast structural material 77 which would otherwise occur around the projections 74A of the core 74. It follows that the cast structural material 77 can be formed in a balanced shape almost free of the problems of irregular variations in wall thickness as well as the problem of casting defects as explained hereinbefore in connection with the prior art.

As a consequence, the main casing 62 can securely prevent oil leaks from the passages 64, while contributing to improve the yield of products assuredly and allowing a greater degree of freedom in designing, including possibilities of providing the main casing body in a more compact form. Further, since there is no necessity for taking into account extra margins in wall thickness of the cast structural material 77, it becomes possible to cut the material and machining costs of the main casing.

Furthermore, the opposite ends of the metal pipe conduits 63 are closed with plugs or the like before they are integrally assembled with the mold core 74 to preclude the possibilities of casting sand of the core 74 intruding into the metal pipes 76. Therefore, there is no necessity for washing the inner side of the metal pipes 76 after fabrication of the cast structural material 77.

Nevertheless, the closure of the opposite ends of the metal pipes 76 with plug material as in the present embodiment is not necessarily required under certain circumstances. Namely, the metal pipes 76 in an unplugged state may be assembled integrally with the mold core 74 if desired. Alternatively, unplugged ends of the metal pipes 76 may be fixedly fitted in the pipe fitting holes 74B and 74D of the mold core 74 if desired. Should casting sand have intruded into the metal pipes 76 in a casting stage, such casting sand can be removed from the metal pipes 76 after casting the cast structural material 77 by washing or other suitable cleaning means.

Figure 3:
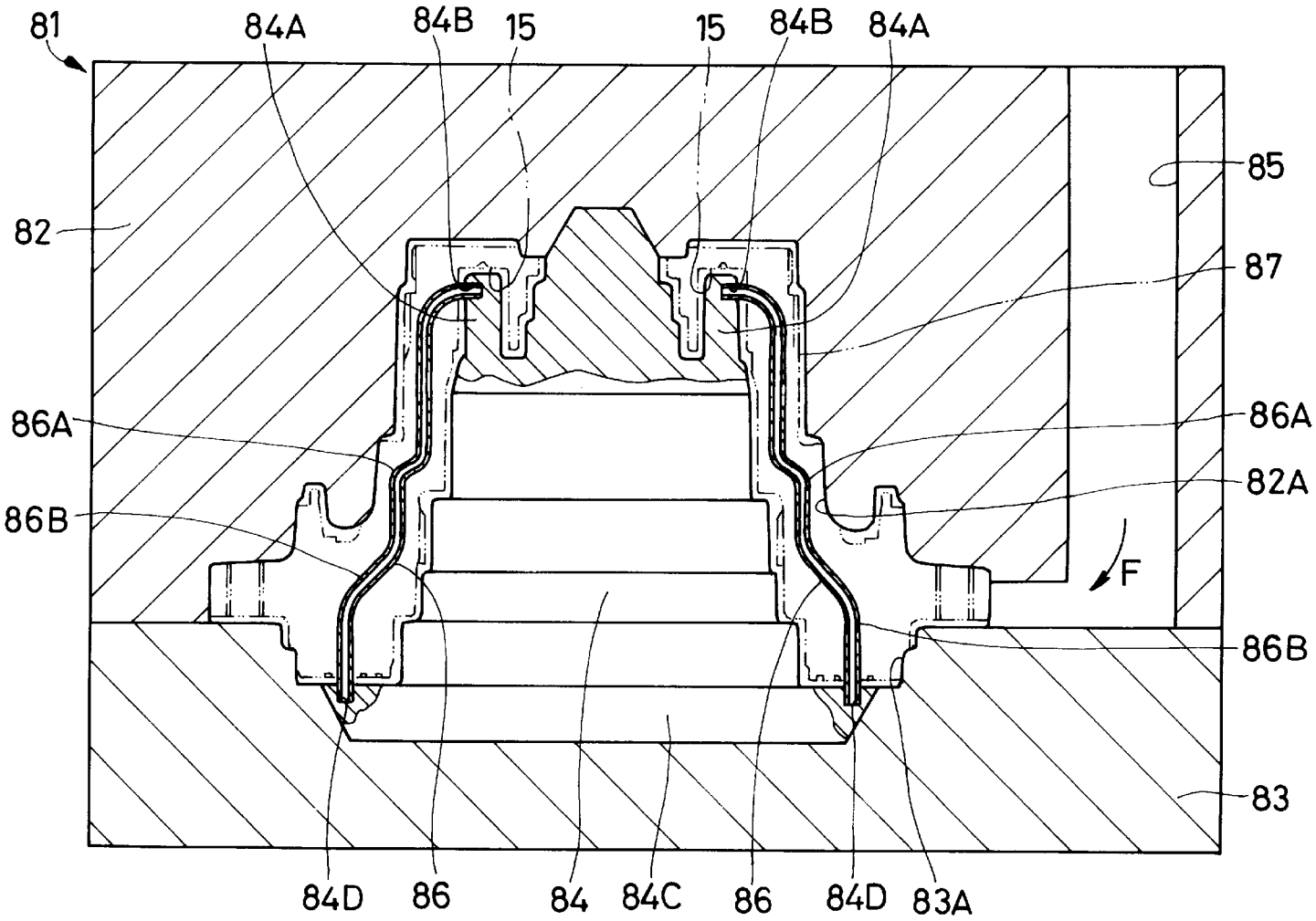
FIG. 3 is a vertical sectional view of a casting mold employed for casing a casing structure for hydraulic motor according to a second embodiment of the invention.

Referring now to FIG. 3, there is shown a second embodiment of the present invention, which has features in that curved or bent portions are provided within the lengths of metal pipes, thereby suppressing undesirable variations in wall thickness of cast structural material and forming structural casing material in a more compact and balanced shape. In the following description, the component parts which are common with the above-described prior art are simply designated by common reference numerals or characters without repeating same explanations.

Indicated at 81 is a casting mold which is to be used for producing a cast structural material 87 as will be described hereinafter, and constituted by upper and lower molds 82 and 83 and a core 84. For instance, the upper and lower molds 82 and 83 and the core 84 are of a sand mold. Cavities 82A and 83A are provided in the upper and lower molds, respectively, and a sprue 85 is formed in the upper mold 82 for pouring molten metal material F into the casting mold 81.

Figure 7:
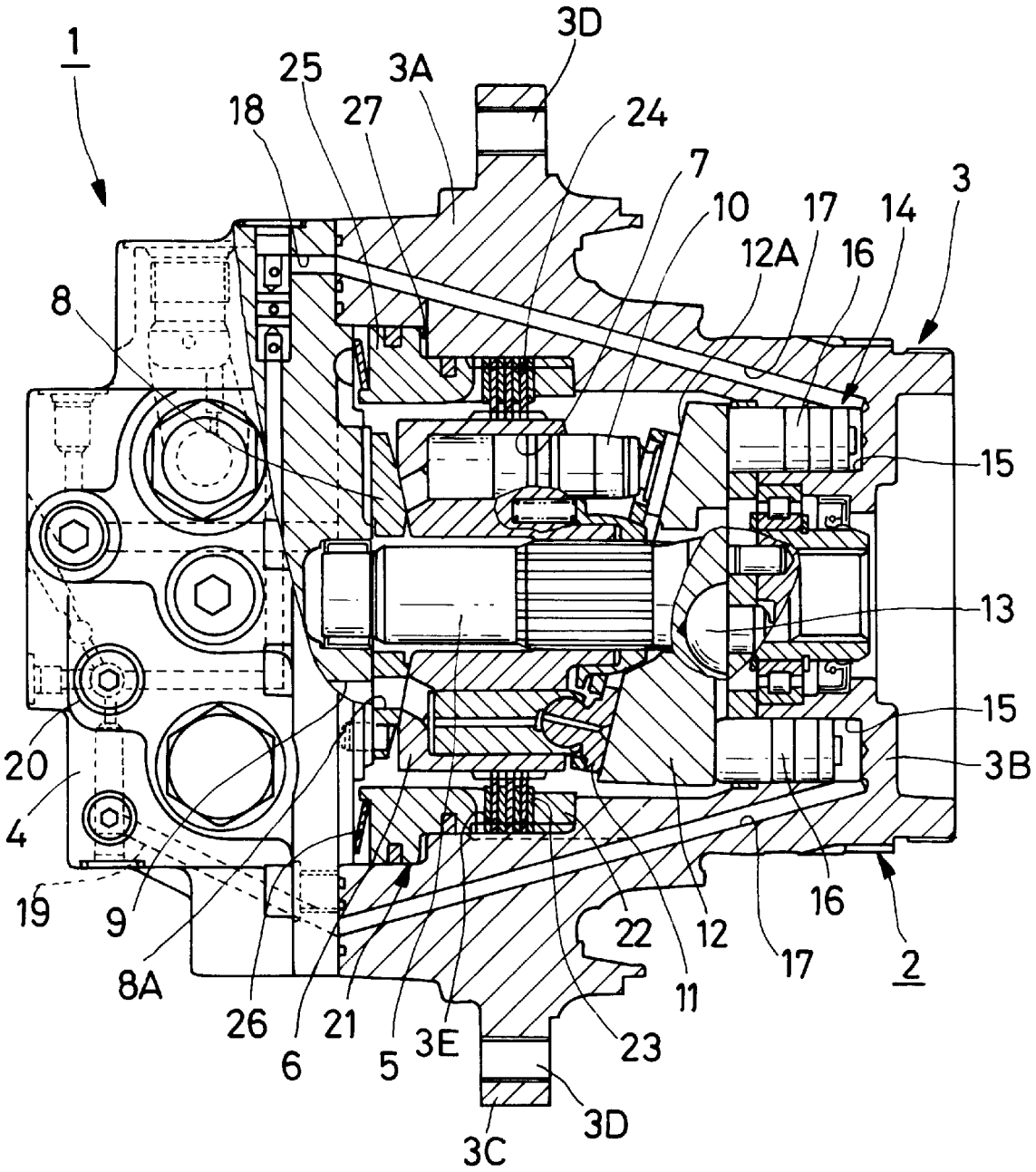
Fig. 7 PRIOR ART
FIG. 7 is an enlarged vertical sectional view of the vehicle drive hydraulic motor shown in FIG. 6.
Figure 8:
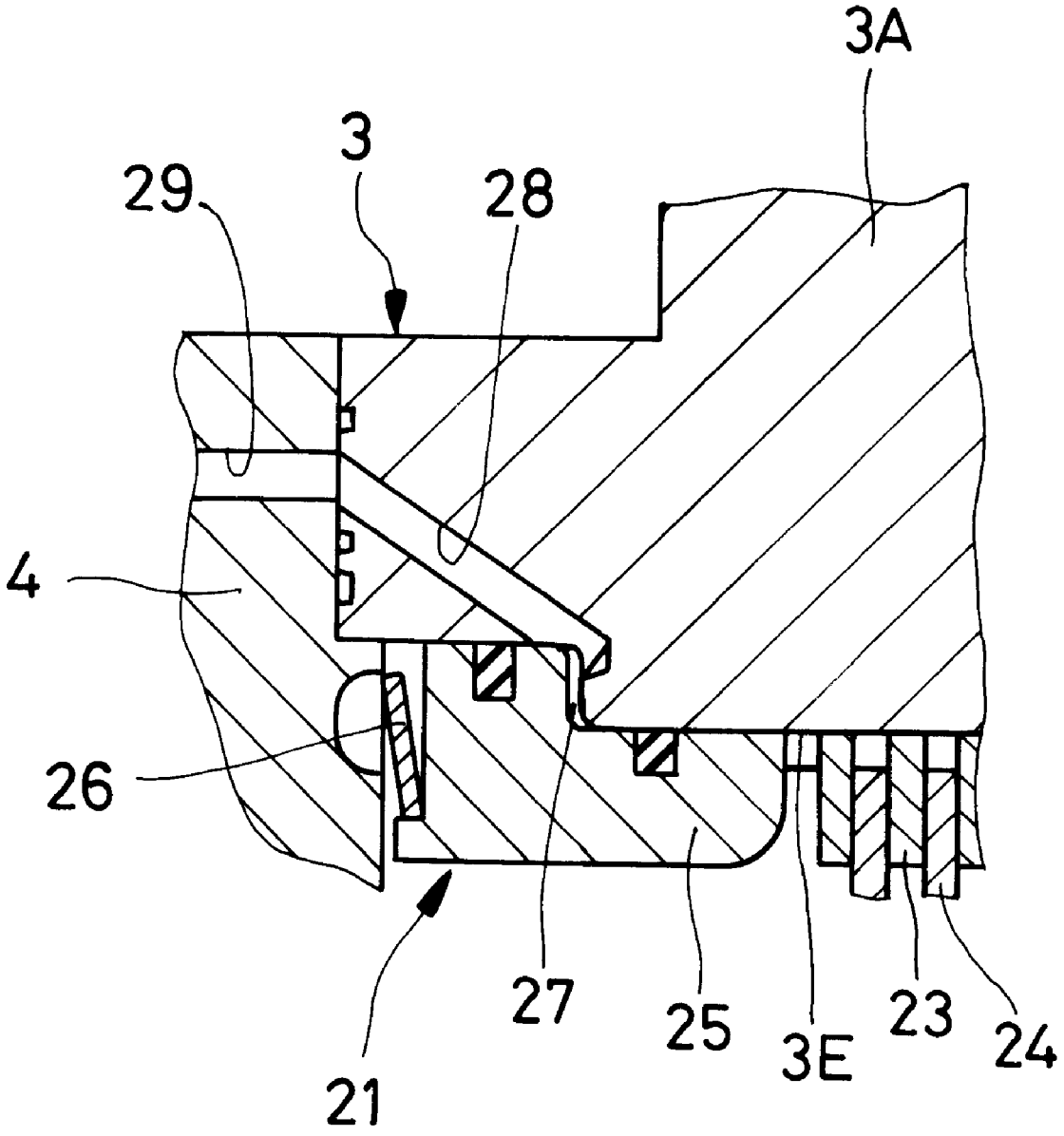
Fig. 8 PRIOR ART
FIG. 8 is an enlarged sectional view of major components of the hydraulic motor, including a brake device and passages provided within a main casing of the hydraulic motor.
Figure 9:
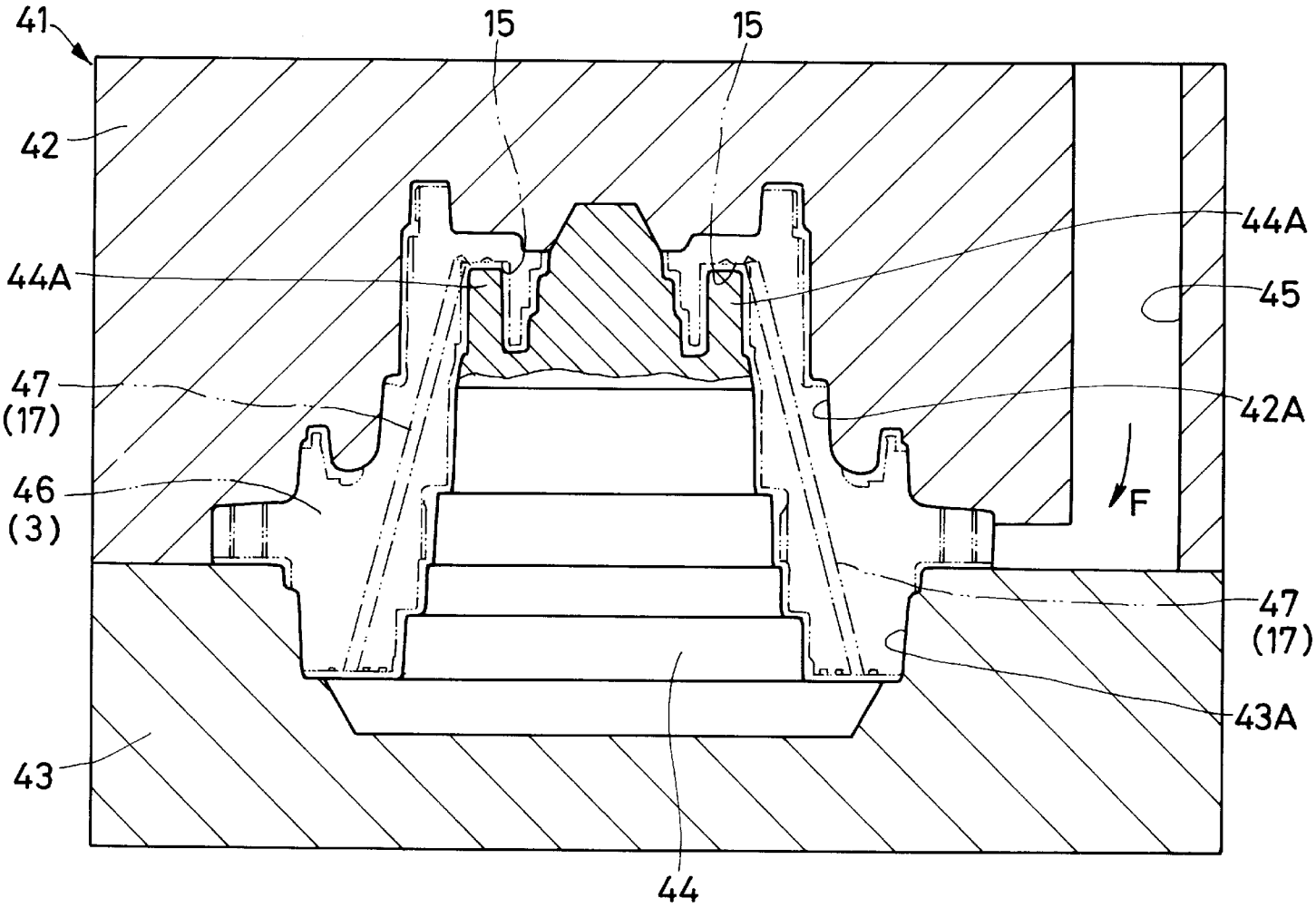
Fig. 9 PRIOR ART
FIG. 9 is a vertical sectional view of a casting mold for casting a hydraulic motor casing structure according to the first prior art.

The mold core 84 is provided with a pair of cylindrical projections 84A at the upper end thereof, in positions corresponding to the respective cylinders 15 of the tilt actuator 14 shown in FIG. 7. Narrow pipe fitting holes 84B are formed radially into upper end portions of the respective projections 84A for integrally fixing therein upper end portions of metal pipes 86 which will be described hereinafter. Further, a pair of pipe fitting holes 84D are formed into the outer periphery of a pedestal portion 84C of the mold core 84 for integrally fixing therein lower ends of the metal pipes 86.

Denoted at 86 are a pair of metal pipes which are set in position within the casting mold 81. Similarly to the first embodiment, initially the metal pipes 86 are each in the form of a narrow rectilinear pipe which is made of a metallic material like iron which has a melting point equivalent to or higher than that of casting metallic material F. The metal pipes 86 are provided with arcuately curved or bent portions 86A and 86B in axially intermediate portions thereof. The opposite ends of each metal pipe 86 are bent to a predetermined angle for the purpose of strengthening their coupling force with the pipe fitting holes 84B and 84D of the mold core 84. In this instance, as seen in FIG. 3, the bent portions 86A and 86B in the metal pipes 86 are formed in a shape which corresponds to the stepped wall portion 62E on the inner periphery of the main casing body 62.

The metal pipes 86 also need to be assembled or connected integrally with the mold core 84. For this purpose, the lower end (one end) of each metal pipe 86 is integrally fixed in a pipe fitting hole 84D in the core 84, while the upper end (the other end) of each metal pipe 86 is integrally fixed in a pipe fitting hole 84B of the core 84. Similarly, the metal pipes 86 are completely enwrapped in molten metal material F as the latter is cast in the mold 81 into a cast structural material 87 to be used for the main casing 62.

Thus, the present embodiment, with the arrangements just described, has substantially the same effects as the foregoing first embodiment. Especially in the present embodiment, however, the curved or bent portions 86A and 86B are provided in middle portions of the metal pipes 86 correspondingly to the profile of the cast structural material 87 to be cast. Therefore, this embodiment can abolish the laborious boring operations and improve the efficiency of the manufacturing process because there is no necessity for boring a number of drill holes 57 in the cast structure, for example, the narrow and elongated drill holes 57A to 57D as in the prior art shown in FIG. 10.

Further, the arcuately bent portions 86A and 86B which are provided in the metal pipes 86 according to the shape of the cast structural material 87 serve to reduce variations in wall thickness of the cast structural material 87 and to form same in a compact and well-balanced shape. Accordingly, in the case of this embodiment, the axial length of the main casing body 62 can be reduced to a significant degree. Consequently, even when the reducer 31 is assembled into the main casing body 62 as exemplified in FIG. 6, the overall length of the hydraulic motor 61 can be reduced for the purpose of solving the problem of damages which might occur to the housing 32 of the reducer 31 as a result of collision thereagainst of jumping stones while the vehicle is in travel along a ground surface.

Figure 4:
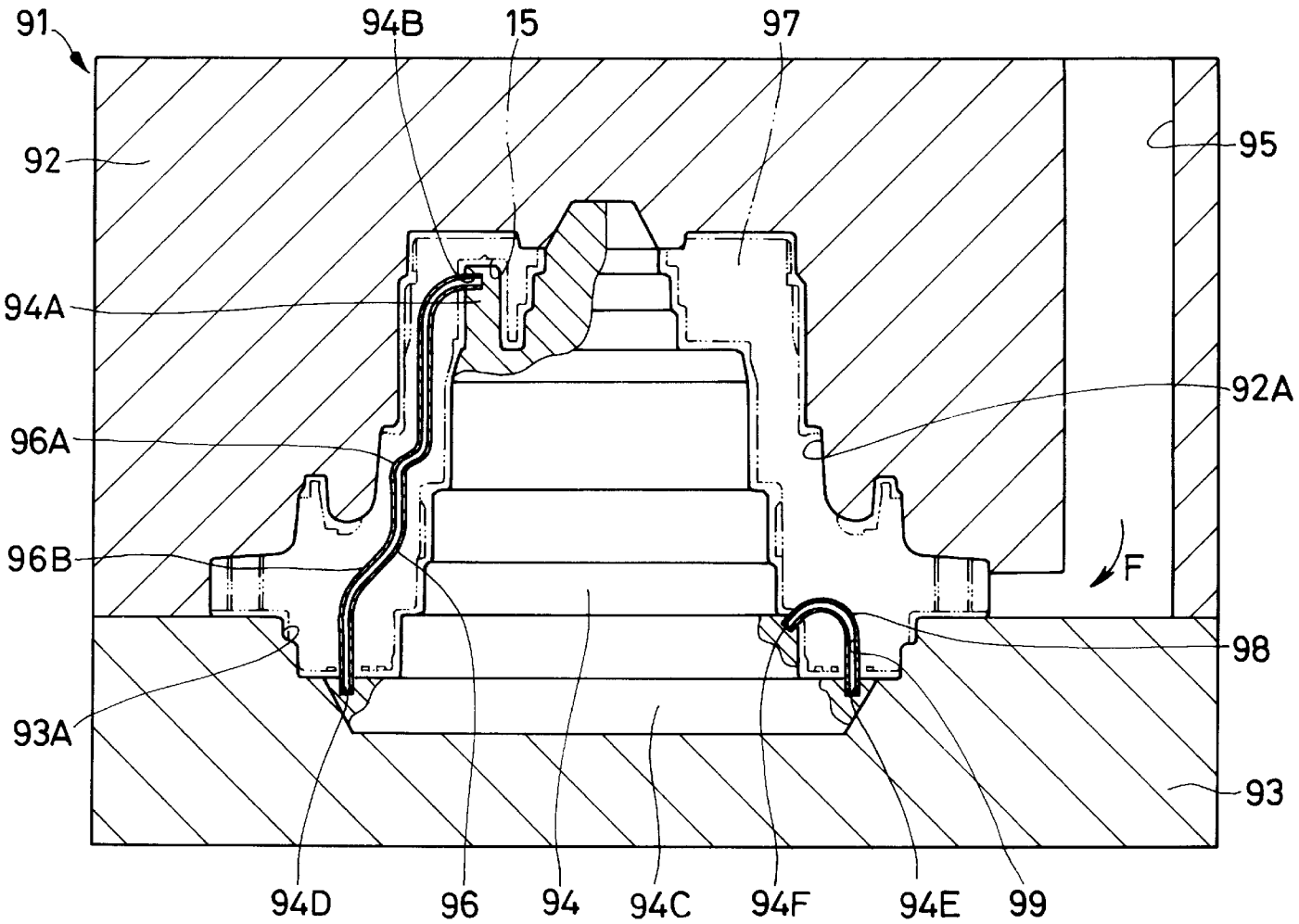
FIG. 4 is a vertical sectional view of a casting mold employed for casting a casing structure for hydraulic motor according to a third embodiment of the invention.

Referring now to FIG. 4, there is shown a third embodiment of the present invention, which has features in that an additional metal pipe is embedded in a cast structural material for the main casing, the additional metal pipe providing a hydraulic passage on the inner peripheral side thereof for supplying a brake cancellation pressure to a hydraulic chamber which is connected to a brake device as an actuator. In the following description, the component parts which are common with the counterparts in the above-described prior art are simply designated by common reference numerals or characters to avoid repetition of same explanations.

Indicated at 91 is a casting mold for forming a cast structural material 97 which will be described hereinafter. Similarly to the casting mold 41 of the prior art described hereinbefore, the casting mold 91 is constituted by upper and lower molds 92 and 93 and a core 94. For example, the just-mentioned upper and lower molds 92 and 93 and core 94 are of a sand mold which is formed of casting sand or the like. The upper and lower molds 92 and 93 are provided with cavities 92A and 93A, respectively, and a sprue 95 is formed in the upper mold 92 for pouring molten metallic material F into the casting mold 91.

The mold core 94 is provided with a cylindrical projection 94A at the upper end thereof. In this instance, the cylindrical projection 94A is located in a position which corresponds to a cylinder 15 of a tilt actuator 14 as shown in FIG. 7. A narrow blind hole 94B is formed radially into an upper end portion of the projection 94A for integrally fixing therein a metal pipe 96 which will be described hereinafter. Further, a narrow pipe fitting hole 94D is bored into the outer periphery of a pedestal portion 94C of the core 94 for integrally fixing therein a lower end portion of the metal pipe 96.

At a position radially opposite to the pipe fitting hole 94D, another pipe fitting hole 94E is formed into the pedestal portion 94C of the core 94. In addition, at a position which is upwardly spaced from the pipe fitting hole 94E by a predetermined distance, still another pipe fitting hole 94F is formed into the core member 94. Similarly to the aforementioned pipe fitting hole 94D, both of the pipe fitting holes 94E and 94F are in the form of a blind hole of small diameter. Integrally fixed in these holes 94E and 94F are the opposite ends of a metal pipe 98 which will be descried hereinafter.

The first metal pipe 96 which is set in position within the casting mold 91 is initially in the form a rectilinear pipe of a metallic material such as iron or the like which has a melting point equivalent with or higher than that of the molten metallic material F. This metal pipe 96 is provided with arcuately curved or bent portions 96A and 96B in its axially intermediate portions correspondingly to the profile of the main casing body 62. Further, opposite end portions of the metal pipe 96 are bent to a predetermined angle for the purpose of enhancing their coupling force with the pipe fitting holes 94B and 94D, respectively.

The metal pipe 96 likewise needs to be integrally connected or assembled with the mold core 94. For this purpose, the lower end (one end) of the metal pipe 96 is integrally fixed in the pipe fitting hole 94D of the mold core 94, while its upper end (the other end) is integrally fixed in the pipe fitting hole 94B of the mold core 94. At the time of casting the structural material 97 for the main casing body 91, the metal pipe 96 is completely enwrapped in the molten metallic material F on its outer peripheral side, providing an passages 64 internally on its inner peripheral side to serve as the metal pipe conduit 63 of FIG. 1.

Indicated at 98 is the second metal pipe which is set in position within the casing mold 91. This metal pipe 98 is arranged similarly to the above-described metal pipe 96 except that it is constituted by a pipe of short length. This metal pipe 98 is provided with carved on bent portion in the form of an inverse U-shape in its axially intermediate portions. The metal pipe 98 is also integrally connected or assembled with the mold core 94, having its lower and upper ends integrally fixed in the pipe fitting holes 94E and 94F of the mold core 94, respectively.

Further, at the time of casting the cast structural material 97 for the main casing body 62, the outer peripheral side of the metal pipe 98 is enwrapped in the casting metallic material F within the casting mold 91. As a result, a passage 99 is formed on the inner peripheral side of the metal pipe 98 to serve as another hydraulic passage. Similarly to the passage 28 of the prior art described hereinbefore in connection with FIG. 8, the passage 99 is used for supplying and discharging of a hydraulic fluid to and from the hydraulic chamber 27 of the brake device 21 as a brake cancellation pressure.

The present embodiment, with the arrangements just described, has substantially the same effects as the foregoing first embodiment. However, especially in this case, since the second metal pipe 98 can be set in position within the casting mold 91 along with the first metal pipe 96, both pipes 96 and 98 can be integrally embedded in the body of the cast structural material 97 simultaneously. This means that the passage 99 for the brake device 21 (the passage 28 of FIG. 8) can be formed in the main casing body 62 easily together with the passage 64 for the tilt actuator 14, making it possible to enhance the yield of products all the more through further improvements in production efficiency.

Figure 5:
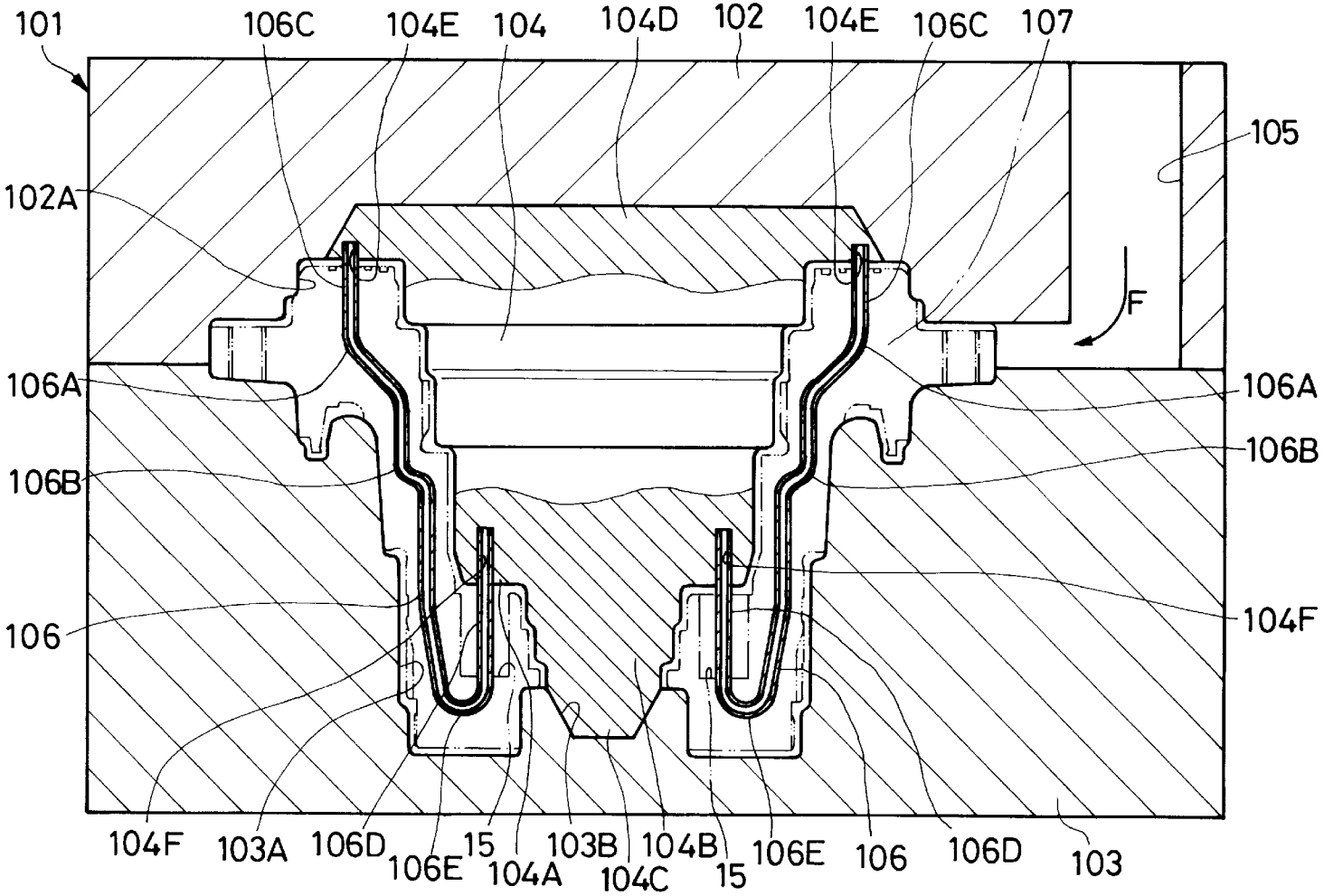
FIG. 5 is a vertical sectional view of a casting mold employed for casting a casing structure for hydraulic motor according to a fourth embodiment of the invention.
Figure 6:
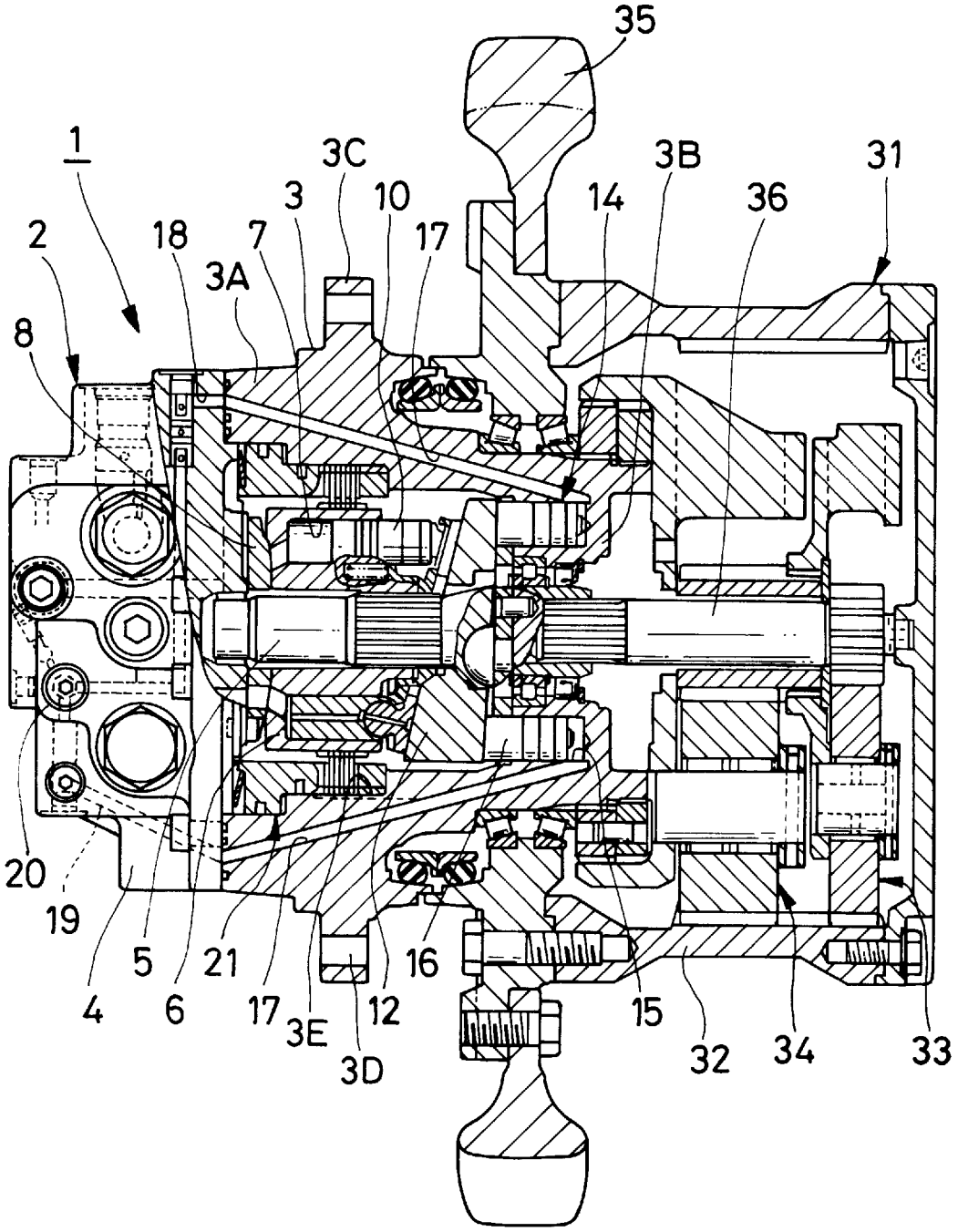
Fig. 6 PRIOR ART
FIG. 6 is a vertical sectional view of a vehicle drive hydraulic motor and reducer assembly according to a first prior art.

Referring now to FIG. 5, there is shown a fourth embodiment of the present invention, which has features in that metal pipes are integrally secured to a mold core by way of straight pipe sections which are provided at the opposite ends of each metal pipe to extend in the same direction and which can be inserted into the mold core simultaneously from the same direction. In the following description, the component parts which are common with the above-described prior art are simply designated by common reference numerals or characters to avoid repetitions of same explanations.

Incidentally, in the forth embodiment of the present invention, the casting mold 101 is formed by matching a cast structural material 107 which will be described hereinafter, but the cast structural material 107 is molded in the condition which is turned upside down against the cast structural material 87 shown in FIG. 3.

Indicated at 101 is a casting mold for producing a cast structural material 107 which will be described hereinafter. Similarly to the casting mold 41 of the prior art described hereinbefore, the casting mold 101 is constituted by upper and lower molds 102 and 103 and a core 104. For example, the upper and lower molds 102 and 103 and the core 104 are of a sand mold and formed of casting sand or the like. Similarly, cavities 102A and 103A are formed in the upper and lower molds 102 and 103, respectively. A sprue 105 is formed in the upper mold 102 for pouring molten metallic material F into the casting mold 101.

In this instance, the cavity 103A of the lower mold 103 includes a conical recess 103B which is formed centrally at the bottom of the lower mold 103. On the other hand, the core 104 includes: a shoulder portion 104A; a stepped cylindrical portion 104B which is projected downward at the center of the shoulder portion 104A and which has its diameter reduced stepwise in the downward direction; and a truncated cone portion 104C of small diameter which is formed integrally at the lower end of the cylindrical portion 104B. Thus, the core 104 can be set in position on the lower mold 103 upon fitting the truncated cone portion 104C in the recess 103B at the bottom of the lower mold 103.

Further, a crown portion 104D in the form of a truncated cone of large diameter is integrally formed at the upper end of the core 104. This crown portion 104D is fitted in a center portion of the upper mold cavity 102A. Thus, the core 104 can be set in position between the upper and lower molds 102 and 103 by way of the crown portion 104D and the truncated cone portion 104C at its upper and lower ends, respectively. Furthermore, a pair of blind pipe fitting holes 104E of small diameter are formed upwardly into the lower side of the crown portion 104D of the core 104. Besides, a pair of blind pipe fitting holes 104F of small diameter are formed upwardly into the lower side of the shoulder portion 104A.

Denoted at 106 are a pair of metal pipes which are set in position within the casting mold 101. These metal pipes 106 are initially in the form of a narrow elongated pipe of a metallic material such as iron or the like which has a melting point equivalent with or higher than that of molten metallic material F. Each one of the metal pipes 106 is provided with arcuately curved or bent portions 106A and 106B correspondingly to the profile of the main casing body 62. These metal pipes 106 each contains a bend 106E of U-shape in a lower end portion to have both of straight pipe sections 106C and 106D at the opposite ends thereof opened in the upward direction. Namely, the lower straight pipe section 106D is upturned through the bend 106E to extend in the same direction with the upper straight pipe section 106C.

In this case, by inserting fore end portions of the straight pipe sections 106C and 106D into the pipe fitting holes 104E and 104F in the upward direction, each metal pipes 106 is securely fixed in these fitting holes 104E and 104F and as a consequence integrally connected to the mold core 104. As the structural material 107 is cast in the mold 101, the metal pipes 106 are completely embedded and enwrapped in the molten metallic material F on their outer peripheral side, forming passages 64 on the inner peripheral side of the embedded metal pipes 106 to serve as hydraulic passages similar to the metal pipe conduits 63 of FIG. 1.

In the casting stage, when the molten metallic material F is poured into the casting mold 102 to cast the structural material 107 therein, an upward buoyant force is generated by the mold metallic material F pushing the metal pipes 106 in the upward direction. By this buoyant force which acts on the metal pipes 106, distal end portions of the straight pipe sections 106C and 106D are forcibly pushed into the pipe fitting holes 104E and 104F of the core 104, so that the metal pipes 106 are securely prevented from coming off the core 104 upon introduction of the molten metallic material F under pressure.

Further, when the cast structural material 107 is ejected from the casting mold 101 subsequent to the casting stage, the distal end portions of the straight pipe sections 106C and 106D of the metal pipes 106 are projected out of the cast structural material 107 in the same direction (in the upward direction in FIG. 5). Therefore, these distal end portions of the straight pipe sections 106C and 106D can be machined with an end mill or other milling machine quite efficiently without imposing a bending load on these distal end portions while milling their end faces. Therefore, this embodiment can prevent deformations of end faces of the metal pipes 106 as well as detachment or defoliation of joint portions of the metal pipes 106 from the material (the cast structural material 107).

The straight pipe section 106D of the metal pipe 106 is cut off simultaneously as a cutting tool reaches bottom portions of cylinders 15 at the time of a machining operation boring the cylinders 15 for the tilt actuator 14. Therefore, by prevention of detachment of joint portions of the metal pipes 106 off the cast structural material 107, the liquid tightness in such joint portions can be improved to guarantee secure supply of pressurized oil to and from the respective cylinders 15 of the tilt actuator 14 for the control of the tilt angle.

With the arrangements just described, the present embodiment can produce substantially the same effects as the foregoing second embodiment. In this particular embodiment, however, the lower straight pipe section 106D is oriented in the same direction (in the upward direction) as the upper straight pipe section 106C, by providing substantially U-shaped bends 106E in lower portions of the metal pipes 106. As a consequence, when assembling the metal pipes 106 integrally with the mold core 104, distal end portions of the straight pipe sections 106C and 106D of both metal pipes 106 can be inserted into the pipe fitting holes 104E and 104F of the mold core 104 axially in a straightforward direction. It follows that the distal end portions of the straight pipe sections 106C and 106D can be very easily placed in the respective pipe fitting holes 104E and 104F.

Thus, according to the present embodiment, the metal pipes 106 can be fitted in and assembled with the core 104 subsequent to a core molding stage. This means that the operation of assembling the metal pipes 106 into the core 104 can be carried out separately from a core molding operation for the purpose of simplifying the procedures of core molding. Besides, the arrangements of this embodiment permits to assemble the metal pipes 106 integrally with the core 104 in an extremely facilitated manner, contributing to enhance the working efficiency as a whole.

Since the metal pipes 106 and mold core 104 can be set in position within the casting mold 101 in an integrally assembled state as described above, the metal pipes 106 can be fixed in the mold core 104 with large coupling force. Therefore, when molten metallic material F is poured into the casting mold 101 in a later casting stage, the metal pipes 106 can be held stably in predetermined positions, permitting to improve the yield of the cast structural material 107 for the main casing body 62 in an assured manner.

Further, in intermediate portions, the metal pipes 106 are provided with arcuately curved or bent portions 106A and 106B correspondingly to the profile of the cast structural material 107, namely, to the shape of the brake mounting stepped wall portion 62E of the main casing body 62. Therefore, this embodiment can improve the efficiency of the casing manufacturing process by abolishing troublesome boring operations which are required, for example, in the case of the second prior art shown in FIG. 10 for boring a plural number of narrow elongated drilled holes 57A to 57D.

Furthermore, the arcuately curved portions 106A and 106B, which are provided in the metal pipes 106 correspondingly to the profile of the cast structural material 107, contribute to reduce variations in wall thickness of the casing material and thus to shape the structural material 107 in a compact and well-balanced form. In addition, since the axial length of the cast structural material 107 as well as the main casing body 62 can be shortened, it becomes possible to minimize the total length of the machine when a reducer 31 is assembled thereinto as exemplified in FIG. 6, providing a solution to the problem of jumping stones which would hit against and cause damages to the housing 32 of the reducer 31 while the vehicle is in travel.

In the above-described first (second or third) embodiment, the metal pipes 76 (86, 96 or 98) are described as being integrally assembled with the core 74 (84 or 94) of the casting mold 71 (81 or 91) at the time of molding. However, in these foregoing embodiment, the opposite ends of the metal pipes 76 (86, 96 or 98) may be fitted and fixed in the respective pipe fitting holes 74B, 74D (84B, 84D, 94B, 94D, 94E or 94F) after molding the core 74 (84 or 94) by the use of casting sand or the like in the same manner as in the fourth embodiment, if desired.

Further, the foregoing embodiments have been directed to the manufacture of the main casing 62 of the hydraulic motor 61, using the cast structural material 77 (87, 97 or 107) with embedded metal pipes 76 (86, 96, 98 or 106). However, it is to be understood that the present invention is not limited to the particular embodiments shown. More specifically, the rear casing 4 can be manufactured by the use of a similar cast structural material with embedded metal pipes, similarly forming pressurized liquid passages on the inner peripheral side of embedded metal pipes to serve, for example, as the passages 18 and 19 shown in FIG. 7.

Moreover, besides hydraulic motors, the present invention is also applicable to variable displacement swash plate type hydraulic pumps.

INDUSTRIAL APPLICABILITY

As clear from the foregoing detailed description, according to the present invention, a main casing of a swash plate type hydraulic rotational machine is formed out of a cast structural material having metal pipes embedded in the body thereof. The metal pipes are completely enwrapped by the material of the cast structural material on the outer peripheral side thereof, forming on the inner peripheral side thereof liquid passages to be used for supplying and discharging hydraulic fluid to and from a tilt actuator. Therefore, at the time of casting the structural material for the main casing, hydraulic passages to and from a tilt actuator can be formed internally of the cast structural material to abolish the boring operations which would otherwise be necessitated in a next stage for boring hydraulic passages in and through the cast structural material.

Accordingly, the cast structural material can be produced in a well-balanced shape, providing a solution to the problems of casting defects, including variations in wall thickness, while preventing liquid leaks from the pressurized liquid passages in a secure manner and at the same time permitting a higher degree of freedom in designing and reductions in material and manufacturing costs.

Besides, according to the present invention, the tilt angle of a swash plate can be variably controlled by supplying and discharging hydraulic liquid to and from the tilt actuator through the embedded metal pipes to drive the swash plate into tilting movements within the casing. In doing so, the use of metal pipes can preclude the possibilities of leaks of tilt control liquid pressures from the hydraulic passages, improving the reliability and service life of the swash plate type hydraulic rotational machine as a variable displacement type rotational machine.

In this instance, the cast structural material employed in the present invention is constituted by a cylindrical body portion which is open at one axial end, and a bottom portion which is located at the other axial end of the cylindrical body and formed with cylinder portions for the tilt actuator. The metal pipes can be embedded in the cast structural material to extend axially from the bottom portion to the opposite open end of the cylindrical body portion.

The above-mentioned cast structural material can be formed in a diverging shape having a gradually reduced diameter from the open end toward the other end of the cylindrical body portion, while the metal pipes can be embedded in an obliquely inclined state along inner peripheral surface of the cylindrical body portion.

Figure 10:
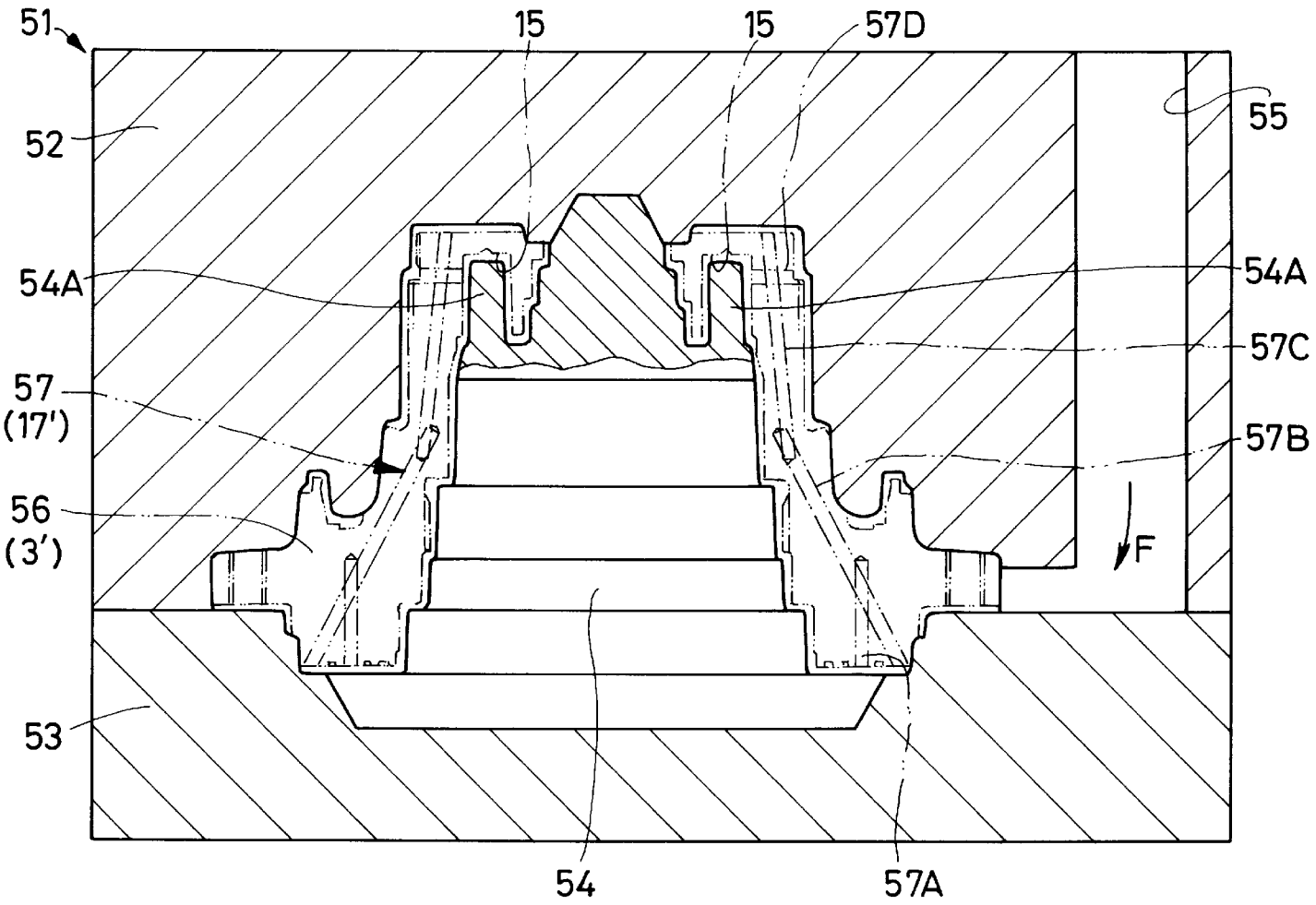
Fig. 10 PRIOR ART
FIG. 10 is a sectional view of a casting mold for casting a hydraulic motor casing structure according to a second prior art.

In case the cast structural material has the inner peripheral surface of its cylindrical body portions diverged stepwise toward the open end, the embedded metal pipes are preferred to have arcuately curved or bent portions in axially intermediate portions correspondingly to the profile of the steppedly diverged cylindrical body portion, for abolishing complicate boring operations which would otherwise be necessitated, for example, as in the second prior art of FIG. 10 for boring hydraulic passages in the steppedly diverging body portion. The use of metal pipes which are curved or bent arcuately correspondingly to the profile of the cast structural material, makes it possible to cast a structural material which has a well-balanced shape and less fluctuations in wall thickness, permitting to cast the structural material in a compact form and in a smaller length, with a greater degree of freedom in designing and substantial cuts in material and machining costs. Besides, even if applied to a vehicle drive hydraulic motor assembly including a reducer or the like, for example, it can solve the problem of damages to the reducer housing as caused by collision of jumping stones or rocks while the vehicle is in travel.

On the other hand, according to the present invention, for supplying and discharging a brake cancellation oil pressure to and from a negative type brake device which is provided in association with a rotor within the casing, the cast structural material for the casing may be arranged to contain another metal pipes which are completely embedded in the body of the cast structural material on their outer peripheral side and which provide hydraulic passages on the inner peripheral side to supply and discharge hydraulic fluid, e.g., a brake cancellation pressure, to and from the brake device. Therefore, the swash plate type hydraulic rotational machine can be used as a hydraulic motor incorporating a negative type brake device, which can prevent leaks of brake cancellation pressures from the hydraulic passages by the use of the embedded metal pipes.

Further, according to the present invention employing metal pipes of narrow elongated shape having a higher melting point than that of the casting casing material, thermal deformations of or thermal damages to the metal pipes can be prevented securely in the casting stage, i.e., at the time of introduction of molten metallic material into the casting mold, allowing to form hydraulic passages through the embedded metal pipes in a highly reliable manner.

Further, according to the present invention, metal pipes of narrow elongated shape can be accurately embedded in the body of a cast structural material by fixing the opposite axial ends of the metal pipes in position relative to a mold in a casting stage.

In this regard, according to the invention, the metal pipes can be integrally assembled with a core of a casting mold beforehand, and set in position within the casting mold along with the core in a casting stage so that the metal pipes can be fixed in position by large coupling force. Accordingly, when molten metallic material is introduced into the casting mold, the metal pipes can be fixedly and stably retained in the respective positions within the casting mold. It follows that the yield of the cast structural material for the casing can be enhanced in a reliable manner.

Furthermore, according to the present invention, the casing material can also be manufactured by the use of metal pipes which are provided with straight pipe sections at the opposite ends thereof, the straight pipe sections being extended in the same direction so that the metal pipes can be inserted and fitted into a core from the same direction, before setting an assembly of metal pipes and core in position within a casting mold. The metal pipes of this sort permit to mold a core to shape separately and independently prior to assembling same with metal pipes, for the purpose of simplifying the core molding process. In addition, the metal pipes can be integrally assembled with a core simply by insertion into the core, and can be fixed in the core with greater coupling force.

Moreover, according to the present invention, the structural material can be manufactured from a metal pipe and core assembly and setting the pipe and core assembly in position within a casting mold, with straight pipe sections projected upward so that the metal pipes are pushed upward by a buoyant force upon introducing molten metallic material into the casting mold in the casting stage. As a result, the straight pipe sections of the metal pipes are forcibly pushed into the core, and are securely prevented from coming off the core under the pressure of molten metallic material which is being introduced into the casting mold.

Furthermore, upon ejecting a cast structural material from the casting mold, the respective straight pipe sections of the metal pipes are projected in the axial direction of the cast structural material, so that end faces of the projected straight pipe portions can be machined efficiently by the use of an end mill or other milling or cutting machines without imposing adverse bending loads on the metal pipes. It follows that this metal pipe arrangement can preclude the defects such as loosening or detachment of metal pipe portions which are joined with the cast structural material, as well as deformations of end faces of the metal pipes.

What is claimed is:

1. A swash plate type hydraulic rotational machine having a cylindrical casing opened at one axial end, a rotational shaft rotatably mounted within said casing, a rotor mounted on said rotational shaft for rotation therewith and provided with a plural number of axial cylinders, a plural number of pistons having one end portions thereof slidably fitted in said cylinders of said rotor and the other end portions projected out of said cylinders, a plural number of shoes provided on projected ends of said pistons, a swash plate mounted within said casing on the side of projected ends of said pistons and having an inclined surface held in sliding contact with said shoes as said rotor is put in rotation, and a tilt actuator provided within said casing between said swash plate and the other end of said casing and arranged to move said swash plate into a tilted position with hydraulic fluid supplied and discharged thereto, characterized in that:

said casing is formed out of a cast structural material containing metal pipes, said metal pipes being completely embedded in a body of said cast structural material on an outer peripheral side thereof and providing hydraulic passages on an inner peripheral side for use as conduits for supplying and discharging hydraulic fluid to and from said tilt actuator.

2. A swash plate type hydraulic rotational machine as defined in claim 1, wherein said cast structural material includes a cylindrical body portion opened at one axial end, and a bottom portion located at the other axial end of said cylindrical body portion and containing cylinders for said tilt actuator, said metal pipes being extended axially through said cylindrical body portion from said opened axial end toward said bottom portion.

3. A swash plate type hydraulic rotational machine as defined in claim 1, wherein said cast structural material includes a diverging cylindrical body portion having a diameter gradually reduced from said opened axial end toward the other end thereof, said metal pipes being embedded in the body of said cast structural material axially in an obliquely inclined state along an inner periphery of said cylindrical body portion.

4. A swash plate type hydraulic rotational machine as defined in claim 1, wherein said cast structural material is provided with stepped walls on the inner periphery of a cylindrical body portion, said metal pipes being provided with bent portions in axially intermediate portions correspondingly to the profile of said cylindrical body portion.

5. A swash plate type hydraulic rotational machine as defined in any of claims 1 to 4, further comprising a negative type brake device mounted between said casing and rotor and supplied with a brake cancellation pressure, and other metal pipes completely embedded in the body of said cast structural material on the outer peripheral side and providing hydraulic passages on the inner peripheral side thereof for use as conduits for supplying and discharging hydraulic fluid to and from said brake device.

6. A swash plate type hydraulic rotational machine as defined in claim 1, wherein said metal pipes are of narrow elongated shape and of a metallic material having a melting point higher than that of said cast structural material for said casing.

7. A swash plate type hydraulic rotational machine as defined in claim 1, wherein said metal pipes are of narrow elongated shape, and are embedded in said cast structural material for said casing by fixing opposite axial ends of said metal pipes in position within a casing mold for said structural material.

8. A method for manufacturing a casing for a swash plate type hydraulic rotational machine having within a casing a rotational shaft, a rotor rotatable integrally with said rotational shaft and provided with a plural number of axial cylinders, a plural number of pistons slidably fitted in the respective cylinders of said rotor, a plural number of shoes provided on projected ends of the respective pistons, a swash plate located face to face with the projected ends of said pistons and held in sliding contact with the shoes as the rotor is put in rotation, and a tilt actuator for driving the swash plate into tilted positions in response to supplied and discharged hydraulic fluid, characterized in that said method comprises the steps of: setting first metal pipes in position within a casting mold at the time of casting a structural material for said casing, thereby forming hydraulic passages within a cast body of said structural material for use as conduits for supplying and discharging hydraulic fluid to and from a tilt actuator; and pouring molten metallic material into said casting mold in such a way as to completely enwrap an outer peripheral side of said first metal pipes in said molten metallic material.

9. A method for manufacturing a casing for swash plate type hydraulic rotational machine as defined in claim 8, further comprising the step of setting second metal pipes in position within said casting mold, in addition to and along with said first metal pipes, thereby forming additional hydraulic passages within a cast body of said structural material for use as conduits for supplying and discharging hydraulic fluid to and from a negative type brake device located between said casing and rotor.

10. A method for manufacturing a casing for swash plate type hydraulic rotational machine as defined in claim 8, wherein said metal pipes are of narrow elongated shape and are set in position by fixing opposite end portions thereof in position within said casting mold.

11. A method for manufacturing a casing for swash plate type hydraulic rotational machine as defined in claim 8 or 9, wherein said casting mold is a split mold having two separably joined mold sections and a core located between said two mold sections, and said metal pipes are integrally assembled with said core and set in position within said casting mold as an integral part of said core.

12. A method for manufacturing a casing for swash plate type hydraulic rotational machine as defined in claim 8, wherein said casting mold is a split mold having two separably joined mold sections and a core located between said two mold sections, and said metal pipes are provided with straight pipe portions extending in the same direction from the opposite ends thereof, said metal pipes being assembled with said core by inserting said straight pipe portions into pipe fitting holes in said core from the same direction and set in position within said casting mold as an integral part of said core.

13. A method for manufacturing a casing for swash plate type hydraulic rotational machine as defined in claim 12, wherein said metal pipes assembled with said core as an integral part thereof and set in position within said casting mold in such a way that distal ends of said straight pipe portions are projected in an upward direction.

14. A swash plate type hydraulic rotational machine as defined in claim 1, wherein said cast structural material is a metal cast structural material.

* * * * *